US007394035B1

(12) United States Patent
Lu

(10) Patent No.: US 7,394,035 B1
(45) Date of Patent: Jul. 1, 2008

(54) ANTI-SWITCH ON/OFF DEVICE

(75) Inventor: Shao-Feng Lu, Taoyuan Hsien (TW)

(73) Assignees: FSP Technology Inc., Taoyuan, Taoyuan Hsien (TW); 3Y Power Technology (Taiwan) Inc., Gueishan Shaing, Taoyuan Hsien (TW)

( * ) Notice: Subject to any disclaimer, the term of this patent is extended or adjusted under 35 U.S.C. 154(b) by 0 days.

(21) Appl. No.: 11/812,335

(22) Filed: Jun. 18, 2007

(51) Int. Cl.
*H01H 9/00* (2006.01)

(52) U.S. Cl. ..... 200/333; 200/51 R

(58) Field of Classification Search ..... 200/43.01, 200/43.16, 43.18, 43.22, 51 R, 51.11, 293, 200/333
See application file for complete search history.

(56) References Cited

U.S. PATENT DOCUMENTS 5,649,839 A * 7/1997 Yu ..... 439/650
6,038,126 A * 3/2000 Weng ..... 361/679
6,215,080 B1 * 4/2001 Mori et al. ..... 200/51 R
6,329,616 B1 * 12/2001 Lee ..... 200/51.03
6,515,851 B1 * 2/2003 Ootori et al. ..... 361/679
7,309,834 B1 * 12/2007 Byrd ..... 174/53

* cited by examiner

*Primary Examiner*—Michael A Friedhofer
(74) *Attorney, Agent, or Firm*—Muncy, Geissler, Olds & Lowe, PLLC

(57) ABSTRACT

An anti-switch on/off device mounted on a power supplier, which is used for driving an electronic equipment, is provided for preventing an erroneous touch on the switch of the power supplier to avoid the power supplier from instantly stopping supplying power. The power supplier includes an electric connecting slot and a power switch on/off unit. The power switch on/off unit has, mounted thereon, a press control button for being pressed by the user to control power on/off. The present invention utilizes an anti-error cover covered on the electric connecting slot and the power switch on/off unit, wherein the anti-error cover has an electric connecting opening mounted thereon for passing therethrough the connection with the external power source and an accommodating space for accommodating the press control button, so that an erroneous touch on the switch and an instant power disconnection can be prevented without interfering a normal power input.

12 Claims, 6 Drawing Sheets

ANTI-SWITCH ON/OFF DEVICE

FIELD OF THE INVENTION

The present invention is related to a switch structure of power supplier, and more particularly to a switch structure of power supplier for preventing an erroneous touch.

BACKGROUND OF THE INVENTION

The power supplier is a power conversion device used to drive the operation of electronic equipment and to convert the external applied electricity into a power mode (e.g., AC power or DC power) suitable for the electronic equipment. The general power supplier, as shown in FIG. 1, utilizes a housing 1 to protect and accommodate the internal electronic components or circuits. The housing 1 has an electric connecting slot 2 and a switch on/off unit 3 respectively mounted thereon, wherein the electric connecting slot 2 is used to electrically connect to the external power source, and the switch on/off unit 3 is connected with the internal electronic circuits for controlling the power conduction. However, because the consumer electronic product becomes thinner and thinner, the power supplier is also required to reduce the volume thereof. Therefore, for achieving this purpose, the design now integrates the electric connecting slot 2 and the switch on/off unit 3 together for reducing the occupied space. But, owing to the narrow space, the switch on/off unit 3 might be erroneously touched as the user connects the power source to the electric connecting slot 2, so that the power supply will suddenly be powered off, and also, the internal electronic components will be damaged because of the burst.

SUMMARY OF THE INVENTION

The object of the present invention is to prevent the user from carelessly touching the switch on/off unit of the power supplier, so as to avoid the internal electronic components from being damaged, which is caused by a sudden voltage drop.

For achieving the object described above, the present invention provides an anti-switch on/off device mounted on a power supplier, which is used for driving an electronic equipment, wherein the power supplier includes an electric connecting slot for inputting the external power source and a power switch on/off unit for controlling power conduction or disconnection, and the power switch on/off unit has, mounted thereon, a press control button for being pressed by the user to control power on/off. An anti-error cover is covered on the electric connecting slot and the power switch on/off unit, and the anti-error cover has an accommodating space for accommodating the press control button so as to prevent the press control button from directly exposing to the outside and from being erroneously touched. And, the anti-error cover has an electric connecting opening located at the position corresponding to that of the electric connecting slot for passing therethrough the connection between the electric connecting slot and an external power line. Furthermore, a position of the anti-error cover corresponding to the power switch on/off unit has a press flexibility, or has a power switch on/off opening, so that the user can directly control the power on/off through the press control button without taking off the anti-error cover. Consequently, the anti-switch on/off device of the present invention can effectively avoid the user from erroneously touching the power switch on/off unit of the power supplier and from causing an instant power disconnection without inconvenience.

BRIEF DESCRIPTION OF THE DRAWINGS

The foregoing aspects and many of the attendant advantages of this invention will be more readily appreciated as the same becomes better understood by reference to the following detailed description, when taken in conjunction with the accompanying drawings, wherein.

DESCRIPTION OF THE PREFERRED EMBODIMENT

Figure 1:
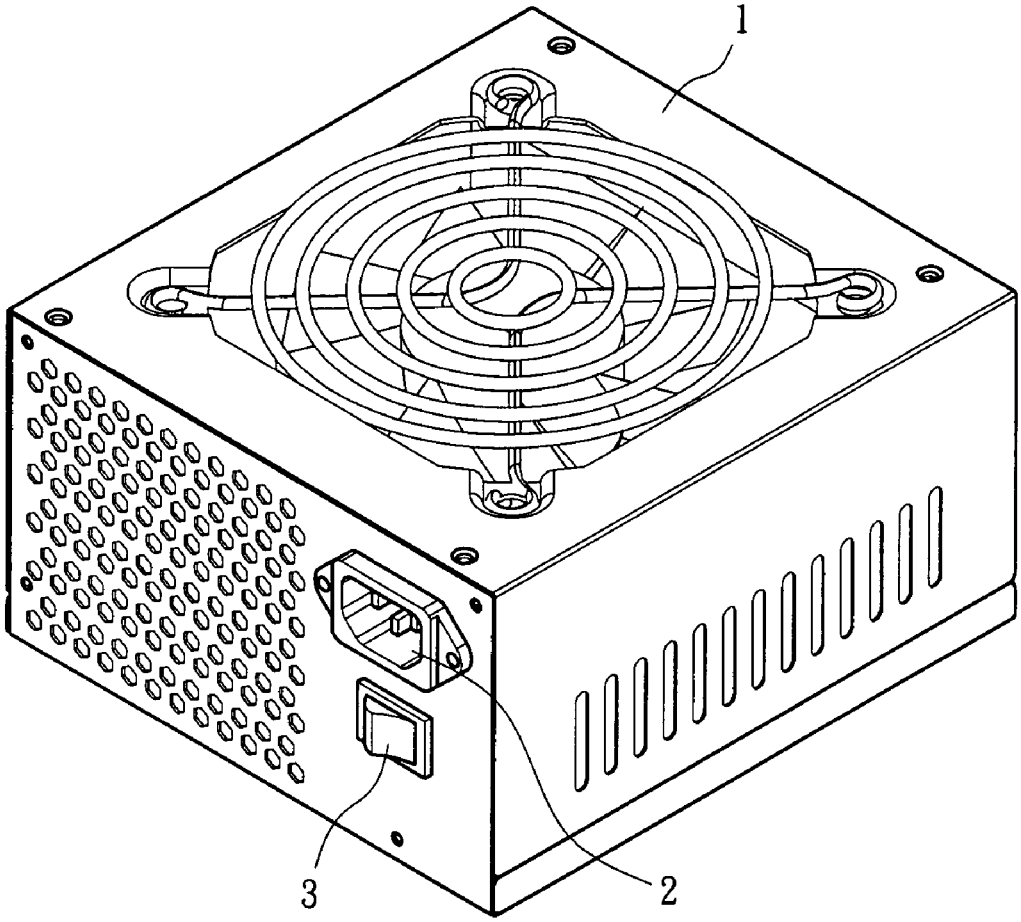
Fig. 1 PRIOR ART
FIG. 1 shows a three-dimensional appearance of a conventional power supplier.
Figure 2:
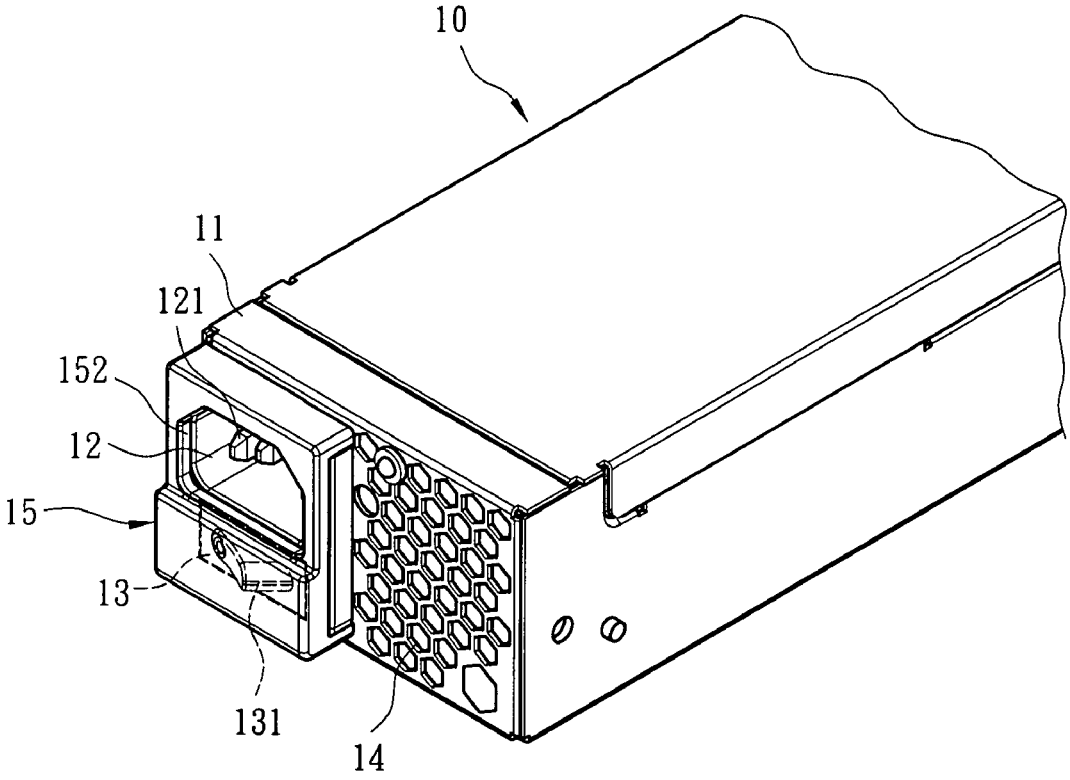
FIG. 2 shows a three-dimensional appearance of a preferred embodiment in the present invention.
Figure 3:
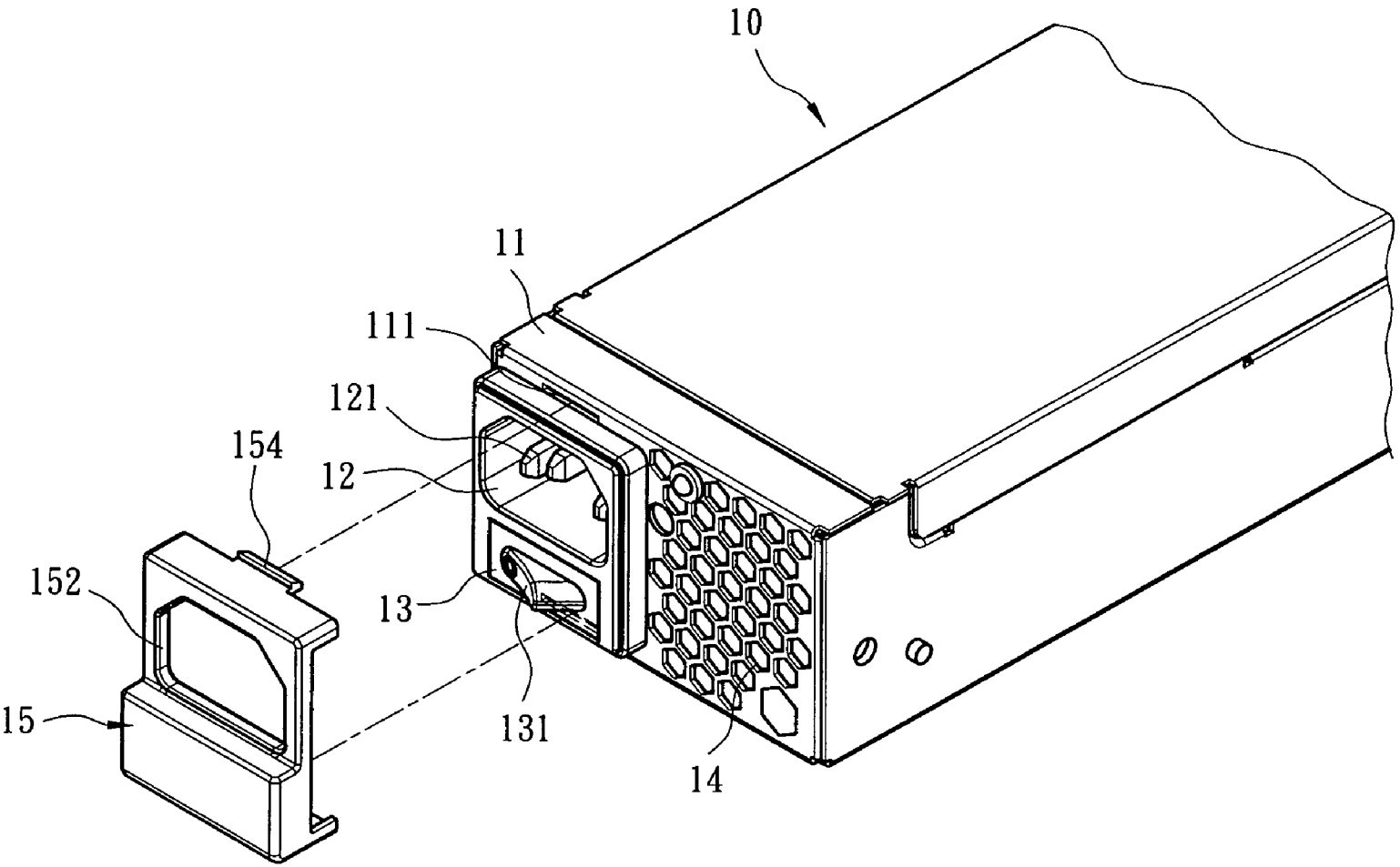
FIG. 3 shows a decomposition drawing of a preferred embodiment in the present invention.
Figure 4:
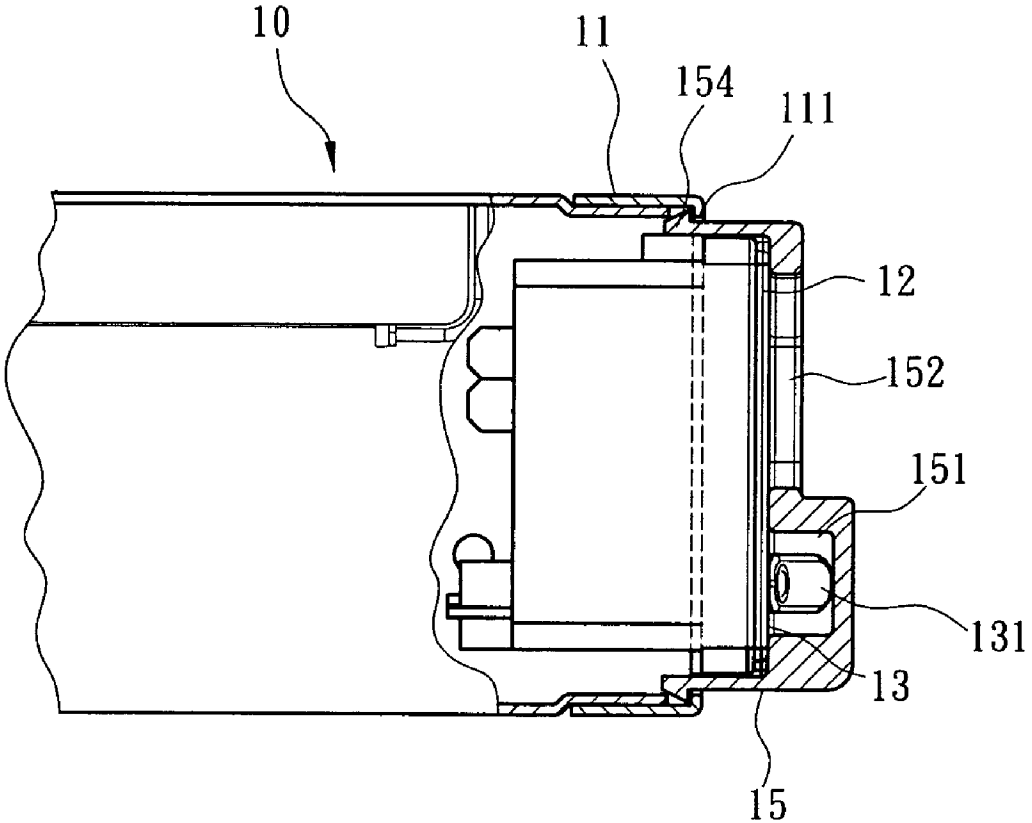
FIG. 4 shows a sectional drawing of a preferred embodiment in the present invention.

Please refer to FIG. 2, FIG. 3 and FIG. 4, which respectively show the appearance, decomposition structure and cross-section of the present invention. As shown, the present invention provides an anti-switch on/off device mounted on a power supplier 10, which is used to drive the operation of an electronic equipment (not shown in the Figs). The power supplier 10 includes an outer housing 11, which has, mounted thereon, an electric connecting slot 12 for inputting an external power source, and a power output port (not shown in the Figs). Between the electric connecting slot 12 and the power output port 12, a power conversion circuit (not shown) located inside the housing is used to be the electrical connection. Through the power conversion circuit converting the electricity from the external power source into the power mode suitable for driving the electronic equipment, the electric connecting slot 12 can be selected to have plural connecting terminals 121 or plural connecting sockets for electrically connecting with different external power plug (not shown in the Figs). Moreover, the power supplier 10 has, mounted thereon, a power switch on/off unit 13, which has a press control button 131 protruded thereon, so that the user can control the power conduction through pressing the press control button 131. Generally, the power supplier 10 further has at least a heat dispersing device 14 for dispersing the heat generated as the power supplier 10 supplies the power. The heat dispersing device 14 can be cooling fan, heat sink or heat pipe.

In the anti-switch on/off device of the present invention, an anti-error cover 15 mounted on the electric connecting slot 12 and the power switch on/off unit 13. The anti-error cover 15 has an accommodating space 151 therein for accommodating the press control button 13 protruded on the outer housing 11, and an electric connecting opening 152 located at the position corresponding to that of the electric connecting slot 12. Through the electric connecting opening 152, the external power line (not shown in the Figs) can be electrically connected with the electric connecting slot 12 directly and smoothly, so that the press control button 131 can be completely covered and protected by the anti-error cover 15 so as to prevent the user from erroneous touching. Furthermore, for fixing the anti-error cover 15 on the outer housing 11, the anti-error cover 15 has a wedging structure 154, and the outer housing 11 has an engaging structure 111 corresponding thereto, so that the anti-error cover 15 can be fixed on the power supplier 10.

Figure 5:
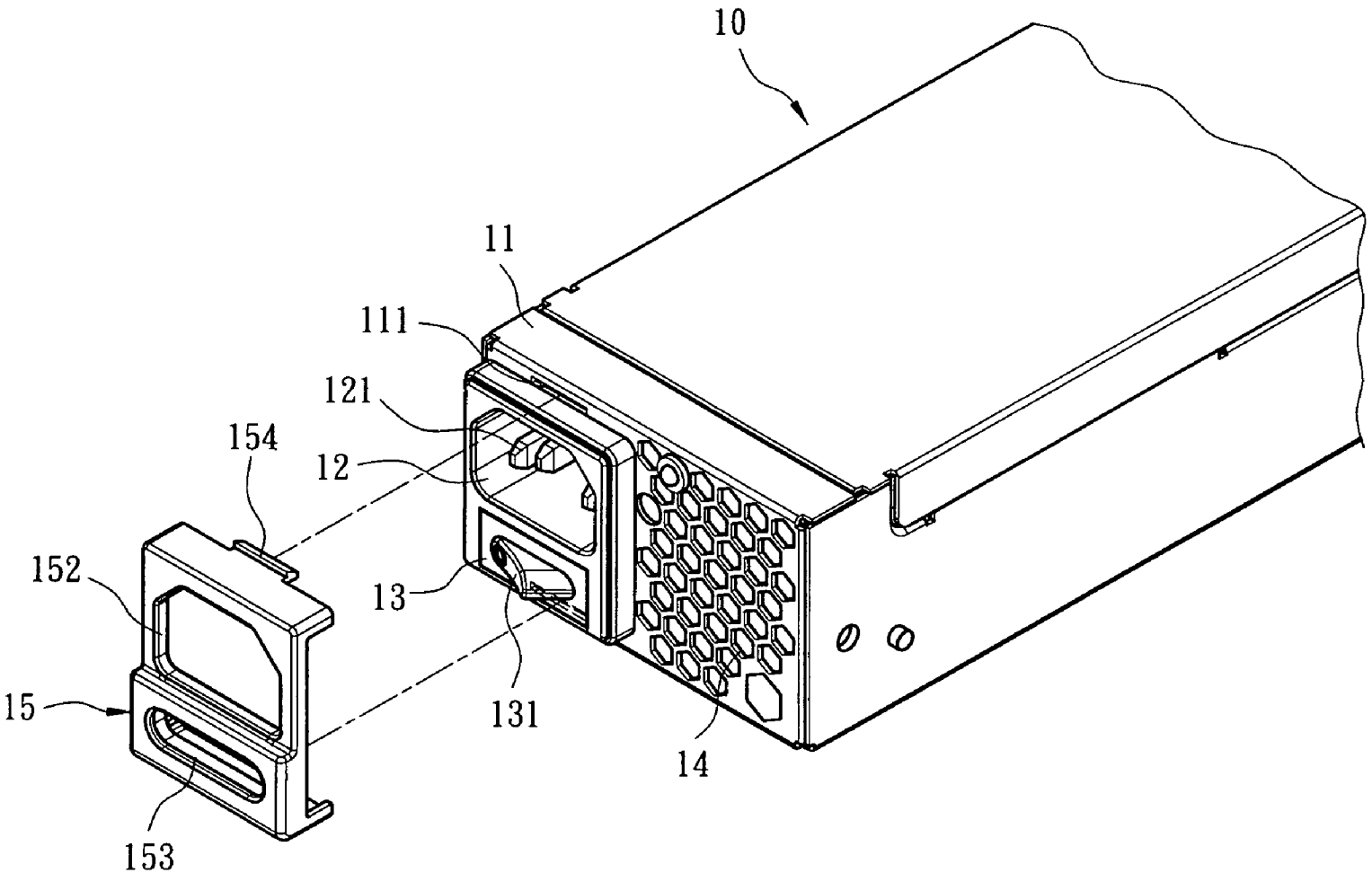
FIG. 5 shows a decomposition drawing of another preferred embodiment in the present invention.

According to the above described embodiment, when the user wants to switch the power, the anti-error cover 15 has to be taken off, so that the press control button 13 can be pressed for power conduction or disconnection, which might be inconvenient. Therefore, in another embodiment of the present invention, the anti-error cover 15 can have a pressing flexibility at the position corresponding to that of the press control button 131, thereby the user can press the button 131 without taking off the anti-error cover In addition, in further another embodiment, as shown in FIG. 5 and FIG. 6, which show the decomposition structure and cross section of the present invention, the anti-error cover 15 has, except the electric connecting opening 152 corresponding to the electric connecting slot 12, a power switch on/off opening 153 located at the position corresponding to the power switch on/off unit 13 and higher than the press control button 131, so that the press control button 131 will not expose to the outside and the user still can directly press the press control button 131 to control power conduction without taking off the anti-error cover 15.

Figure 6:
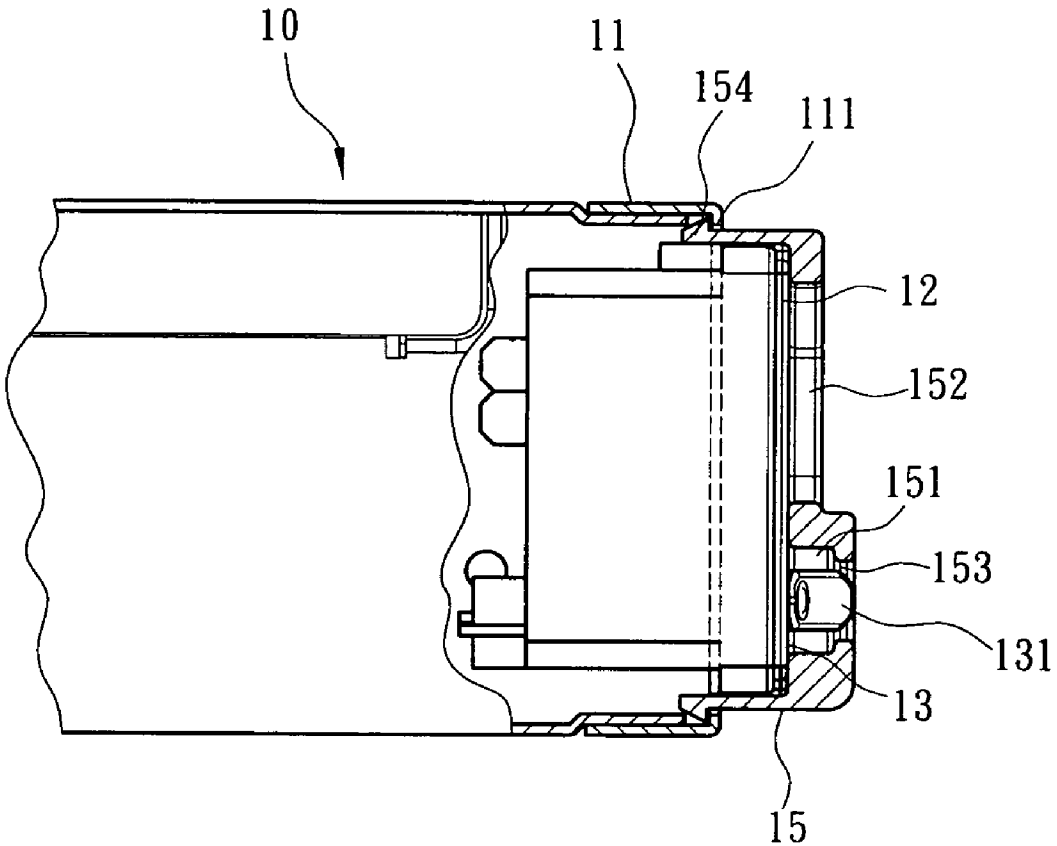
FIG. 6 shows a sectional drawing of another preferred embodiment in the present invention.

As shown in FIG. 4 and FIG. 6, which respectively show cross sections of two embodiments in the present invention, the anti-error cover 15 which is covered on the electric connecting slot 12 and the power switch on/off unit 13 has an accommodating space 151 for accommodating the press control button 131, so that the press control button 131 on the outer housing 11 can be completely covered in the anti-error cover 15, thereby effectively preventing the user's erroneous touching on the button 131 and also avoiding the power switch on/off unit 13 from turning off which may cause the power supplier 10 to lose power supply.

In the aforesaid, the anti-switch on/off device of the present invention utilizes an anti-error cover 15, which is covered on the electric connecting slot 12 and the power switch on/off unit 13, to prevent the user from erroneously touching the press control button 131 of the power switch on/off unit 13 which may cause a power disconnection of the power supplier 10, and even damage, owing to the burst, the electronic components inside the electronic device. Furthermore, an electric connecting opening 152 is opened on the anti-error cover 15 so as to provide the external power input the pass to the power supplier 10.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An anti-switch on/off device mounted on a power supplier, which is used for driving an electronic equipment, wherein the power supplier comprises an outer housing, which at least has an electric connecting slot for inputting an external power source and a power switch on/off unit for controlling power conduction or disconnection, and the power switch on/off unit has, mounted thereon, a press control button for being pressed by a user to control power on/off, characterized in that:

an anti-error cover is covered on the electric connecting slot and the power switch on/off unit, and the anti-error cover has an accommodating space for accommodating the press control button and an electric connecting opening located at a position corresponding to that of the electric connecting slot for passing therethrough the connection between the electric connecting slot and an external power line.

2. The anti-switch on/off device as claimed in claim 1, wherein the anti-error cover has a wedging structure and the outer housing has an engaging structure corresponding to the wedging structure, so as to fix the anti-error cover on the power supplier.

3. The anti-switch on/off device as claimed in claim 1, wherein the electric connecting slot has plural connecting terminals for connecting with the external power source.

4. The anti-switch on/off device as claimed in claim 1, wherein the electric connecting slot has plural connecting sockets for connecting with the external power source.

5. The anti-switch on/off device as claimed in claim 1, wherein the anti-error cover has a power switch on/off opening located at the position corresponding to the power switch on/off unit and above the top of the press control button.

6. The anti-switch on/off device as claimed in claim 5, wherein the anti-error cover has a wedging structure and the outer housing has an engaging structure corresponding to the wedging structure, so as to fix the anti-error cover on the power supplier.

7. The anti-switch on/off device as claimed in claim 5, wherein the electric connecting slot has plural connecting terminals for connecting with the external power source.

8. The anti-switch on/off device as claimed in claim 5, wherein the electric connecting slot has plural connecting sockets for connecting with the external power source.

9. The anti-switch on/off device as claimed in claim 1, wherein a position of the anti-error cover corresponding to the power switch on/off unit has a press flexibility.

10. The anti-switch on/off device as claimed in claim 9, wherein the anti-error cover has a wedging structure and the outer housing has an engaging structure corresponding to the wedging structure, so as to fix the anti-error cover on the power supplier.

11. The anti-switch on/off device as claimed in claim 9, wherein the electric connecting slot has plural connecting terminals for connecting with the external power source.

12. The anti-switch on/off device as claimed in claim 9, wherein the electric connecting slot has plural connecting sockets for connecting with the external power source.

* * * * *